US009437941B1

(12) United States Patent
Rao et al.

(10) Patent No.: US 9,437,941 B1
(45) Date of Patent: Sep. 6, 2016

(54) SPLITTER TYPE TERMINAL BLOCK CONNECTOR

(71) Applicant: Jiang Men Top Electric Intelligence Co., Ltd, Guangdong (CN)

(72) Inventors: Xiaopo Rao, Guangdong (CN); Boqing Yin, Guangdong (CN)

( * ) Notice: Subject to any disclaimer, the term of this patent is extended or adjusted under 35 U.S.C. 154(b) by 0 days.

(21) Appl. No.: 14/983,592

(22) Filed: Dec. 30, 2015

(30) Foreign Application Priority Data

Sep. 29, 2015 (CN) ..... 2015 2 0759001

(51) Int. Cl.
*H01R 25/00* (2006.01)
*H01R 9/24* (2006.01)
*H01R 4/02* (2006.01)

(52) U.S. Cl.
CPC ..... *H01R 9/24* (2013.01); *H01R 4/029* (2013.01)

(58) Field of Classification Search
CPC ..... H01R 31/06; H01R 23/025
USPC ..... 439/638, 344, 362, 654, 736, 676, 655, 439/701, 686, 687, 79
See application file for complete search history.

(56) References Cited

U.S. PATENT DOCUMENTS 4,817,283 A * 4/1989 Johnston ..... H01R 43/16 29/883
4,904,209 A * 2/1990 Nelson ..... H01R 24/62 439/638
5,199,896 A * 4/1993 Mosquera ..... H01R 12/714 29/842
5,759,067 A * 6/1998 Scheer ..... H01R 13/6641 439/607.26
6,328,595 B1 * 12/2001 Chang ..... H01R 13/6641 439/490
6,514,086 B2 * 2/2003 Liao ..... H01R 13/6469 439/638
6,641,443 B1 * 11/2003 Itano ..... H01R 13/6474 439/676

* cited by examiner

*Primary Examiner* — Phuongchi T Nguyen
(74) *Attorney, Agent, or Firm* — Prakash Nama; Global IP Services, PLLC

(57) ABSTRACT

A splitter type terminal block connector having front metal contact pieces while each of them has two front wire connection metal blocks each having a front rectangular frame, a front resilient metal strip curled upward from the bottom side of one end of the front rectangular frame to abut against an inner top side of the front rectangular frame, a long pin and a short pin provided at another end of the front rectangular frame, and a front hole; also having a rear metal contact piece each having two rear wire connection metal blocks while each of them has a rear rectangular frame, a rear resilient metal strip curled upward from the bottom side of one end of the rear rectangular frame to abut against an inner top side of the rear rectangular frame, two rear pins provided at another end of the rear rectangular frame, and a rear hole.

6 Claims, 20 Drawing Sheets

SPLITTER TYPE TERMINAL BLOCK CONNECTOR

BACKGROUND OF THE INVENTION

The present invention relates to the technical field of configuring a terminal block, and more specifically relates to a splitter type terminal block connector allowing wire connection by insertion and achieving wire connection and wire disconnection by press buttons. The splitter type terminal block connector allows a pair of wires to be connected at its input end and multiple pairs of wires to be connected at its output end.

A terminal block is a connector part used in electronic devices and electrical appliances for wire and power connection. It is an important wire connector for electrical connection and connection between one terminal block and another terminal block. Terminal blocks now available in the market have various different structures. However, they cannot achieve instant wire connection. In general, they require disassembly so that wires can be connected thereon by using for example, screw bolts and rivets. Accordingly, it is very complicated and effort draining to mount the wires and achieve connection, thereby increasing labour input but complicating the process and reducing the efficiency of wire connection. Moreover, it is very inconvenient since the terminal block has to be disassembled again and those fixation parts such as screw bolts have to be loosened to separate the wires from the contact pieces of the terminal block during disconnection of the wires from the terminal block. In particular, wire connection of those existing electronic devices or electrical appliances requires coordination between at least two terminal blocks for connection of hard wires and soft wires or wires of different wire strands, and there will be great trouble when the two terminal blocks cannot achieve instant connection. When a mega project requires wire connection in-situ, time and manpower input will be enormous in order to complete the complicated wire connection procedures. It is therefore not beneficial with respect to reducing the cost and labour input.

Although connector parts such as terminal blocks enabling instant wire connection have been developed, these terminal blocks are generally disadvantageous with respect to their complicated structures. Therefore, they are not easy to manufacture and involve a higher manufacturing cost. Also, the resulting wire connection is not good enough because the wires are not connected steadily and thus susceptible to accidental disconnection. Furthermore, they do not support quick connection and do not have a long service life. In particular, none of the prior arts has disclosed a configuration of terminal block suitable for wire connection of flexible wire and hard wire for quick mutual connection between two terminal blocks, or a configuration of terminal block enabling quick connection with an electronical device through one terminal block.

BRIEF SUMMARY OF THE INVENTION

In view of the aforesaid disadvantages now present in the prior art, an object of the present invention is to provide a kind of splitter type terminal block connector allowing wire connection by insertion and achieving wire connection and wire disconnection by press buttons, wherein a pair of wires is connected at its input end and multiple pairs of wires are connected at its output end. Accordingly, there can be one pair of soft/hard wires for input and multiple pairs of soft/hard wires for output. In other words, two ends of the splitter type terminal block connector can allow connection with soft and hard wires. To connect and disconnect wires, press a respective press button so that its press end presses downwardly against respective resilient metal strips to create a gap between the resilient metal strips and the respective rectangular frames, whereby wires can be inserted easily into the gap through the respective wire insertion opening; when the press button is released, the resilient metal strips press the wires tightly against the rectangular frames, thereby completing wire connection. This kind of wire connection is very firm and steady, wherein all the wire connection procedures do not require the terminal block to be disassembled. Hence, instant wire connection is achieved easily and conveniently with simple yet highly efficiently operation steps. To disconnect the wires, press the press buttons again to release the wires easily.

The present invention adopts the following technical scheme: a splitter type terminal block connector comprising an insulated shell, front metal contact pieces and a rear metal contact mounted inside the insulated shell. Front fixation seats for fixing the front metal contact pieces and a rear fixation seat for fixing the rear metal contact piece are provided inside the insulated shell. The front metal contact pieces and the rear metal contact piece are electrically connected by being welded onto a circuit board. Front wire insertion openings corresponding to the front fixation seats and the front metal contact pieces are provided on a front portion of the insulated shell. A rear wire insertion opening corresponding to the rear fixation seat and the rear metal contact piece is provided on a rear portion of the insulated shell. A top portion of the insulated shell is provided with front press buttons through the insulated shell and corresponding to the front metal contact pieces, and a rear press button through the insulated shell and corresponding to the rear metal contact piece. Coordination between the front press buttons and the front metal contact pieces and between the rear press button and the rear metal contact piece allows wire connection and disconnection with the front metal contact pieces and the rear metal contact piece respectively. There are at least two front metal contact pieces and one rear metal contact piece. Each of the front metal contact pieces has two front wire connection metal blocks adjacent and connected with each other. Each of the front wire connection metal blocks comprises a hollow front rectangular frame, a front resilient metal strip having one end formed at a bottom side of one end of the front rectangular frame and another end curled upward in a C shape so as to insert into the front rectangular frame and abut against an inner top side of the front rectangular frame, a long pin and a short pin integrated integrally with the front rectangular frame as a one whole piece provided at an upper part and a lower part of another end of the front rectangular frame, and a front hole positioned on a top part of the front wire connection metal block to allow a press end of a respective front press button to pass through to press against the front resilient metal strip 13. Front insertion holes corresponding to the short pin and long pin of each of the front wire connection metal blocks are provided on the circuit board. The rear metal contact piece has two rear wire connection metal blocks adjacent and connected to each other. Each of the rear wire connection metal blocks comprises a hollow rear rectangular frame, a rear resilient metal strip having one end formed at a bottom side of one end of the rear rectangular frame and another end curled upward in a C shape so as to insert into the rear rectangular frame and abut against an inner top side of the rear rectangular frame, two rear pins provided at an upper part and a middle part of another end of the rear rectangular frame respectively and integrated integrally with the rear rectangular frame as a one whole piece, and a rear hole positioned on a top part of the rear wire connection metal block to allow a press end of the rear press button to pass through to press against the rear resilient metal strip. Rear insertion holes corresponding to the rear pins are provided on the circuit board. The two rear pins of the rear rectangular frame are provided at different sides of said another end of the rear rectangular frame.

Further, the rear rectangular frame is larger than the front rectangular frame; each of the rear pins has a same length as the long pin; the front hole is positioned at one side of a top part of the front rectangular frame; the rear hole is positioned at the middle of a top part of the rear rectangular frame.

Further, the insulated shell is formed by an upper shell and a lower shell. The front fixation seats and the rear fixation seat are configured in the lower shell. The front press buttons and the rear press button are configured on the upper shell and are integrally formed with the upper shell as a one whole piece. The front fixation seats are formed by locking panels and rectangular locking blocks for fixing the front wire connection metal blocks 11, wherein each of the front wire connection metal blocks is sandwiched between two respective locking panels or between a respective locking panel and a respective rectangular locking block so as to be limited and fixed in position. The rear fixation seat is formed by three sideward blocking panels and two limiting panels; a side of the rear fixation seat corresponding to the rear wire insertion opening is not being blocked.

Further, each of the front press buttons and the rear press button is formed by a resilient press strip and downwardly protruding press tips formed at a bottom side of the resilient press strip. The press tips correspondingly pass through the front hole/the rear hole to press against respective front resilient metal strips/rear resilient metal strips. An anti-slippery groove enabling easier pressing is provided respectively on a top part of each of the front press buttons and the rear press button.

Further, locking slots are provided on a side wall of the upper shell; buckles that fittingly correspond to the locking slots to enable connection and fixation between the upper shell and the lower shell are provided on the lower shell.

Further, the circuit board uses series circuit power connection or parallel circuit power connection.

In view of the above, the splitter type terminal block connector of the present invention has the following advantages: the splitter type terminal block connector allows wire connection by insertion and achieving wire connection and wire disconnection by press buttons, wherein a pair of wires is connected at its input end and multiple pairs of wires are connected at its output end. Accordingly, there can be one pair of soft/hard wires for input and multiple pairs of soft/hard wires for output. In other words, two ends of the splitter type terminal block connector can allow connection with soft and hard wires. To connect and disconnect wires, press a respective press button so that its press end presses downwardly against respective resilient metal strips to create a gap between the resilient metal strips and the respective rectangular frames, whereby wires can be inserted easily into the gap through the respective wire insertion opening; when the press button is released, the resilient metal strips press the wires tightly against the rectangular frames, thereby completing wire connection. This kind of wire connection is very firm and steady, wherein all the wire connection procedures do not require the terminal block to be disassembled. Hence, instant wire connection is achieved easily and conveniently with simple yet highly efficiently operation steps. To disconnect the wires, press the press buttons again to release the wires easily.

DETAILED DESCRIPTION OF THE INVENTION

Embodiment 1

Figure 1:
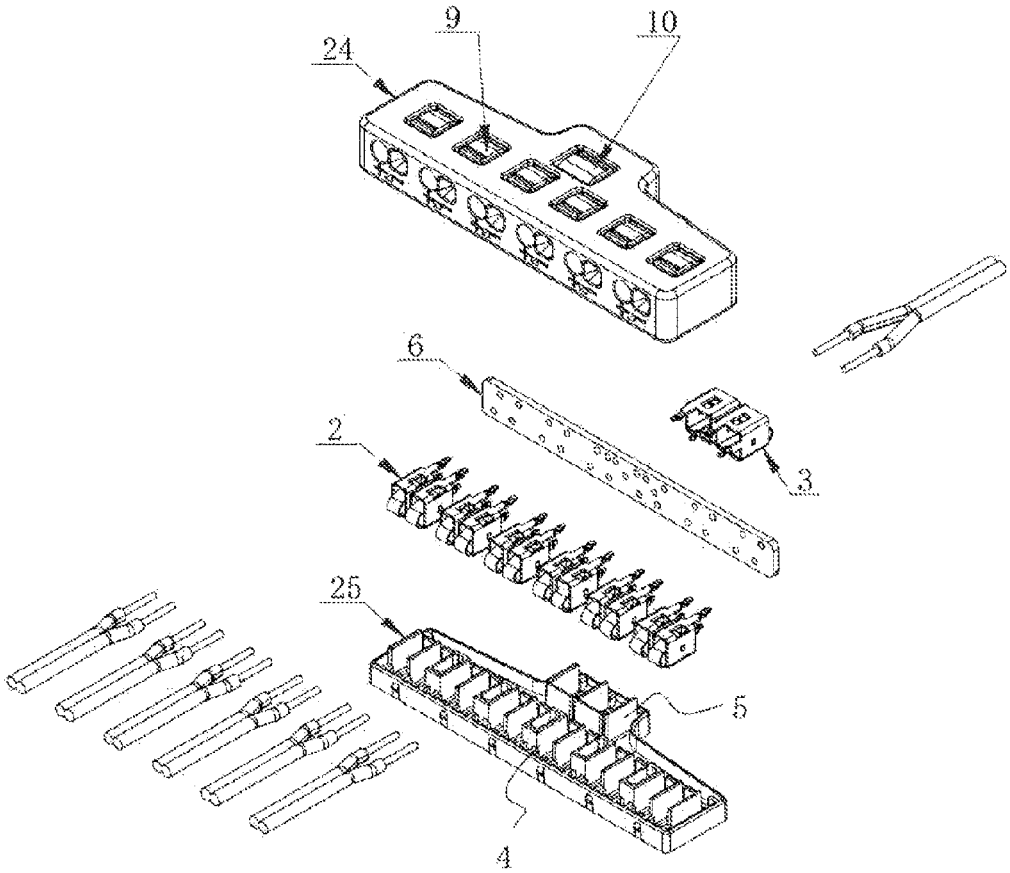
FIG. 1 is an exploded view showing a structure of the splitter type terminal block connector according to embodiment 1 of the present invention when the splitter type terminal block connector is connected with wires.
Figure 2:
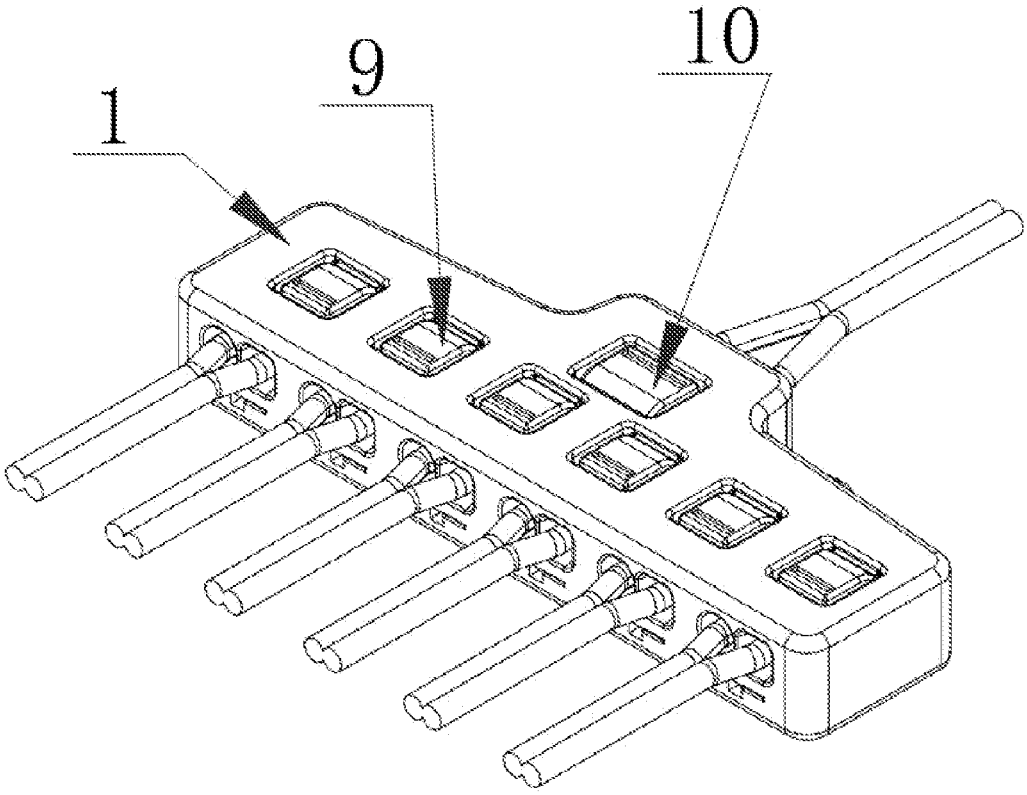
FIG. 2 is a structural view of the splitter type terminal block connector according to embodiment 1 of the present invention when the splitter type terminal block connector is connected with wires.
Figure 3:
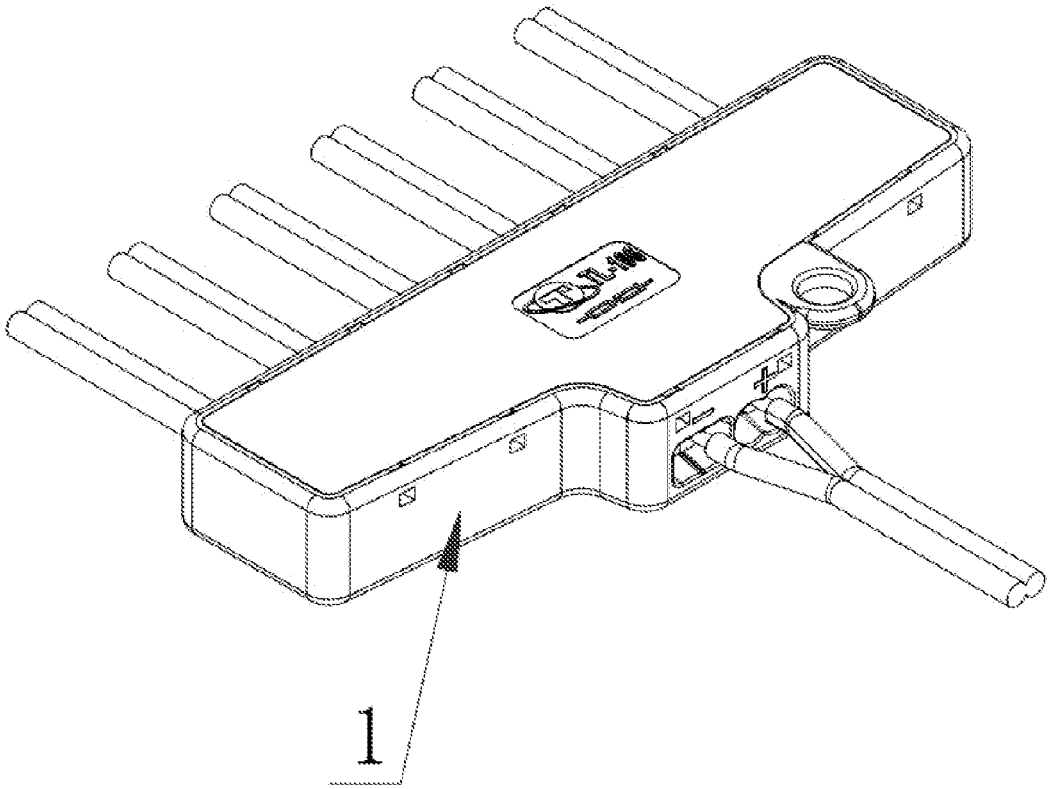
FIG. 3 is the same splitter type terminal block connector of FIG. 2 shown in another angle of view.
Figure 4:
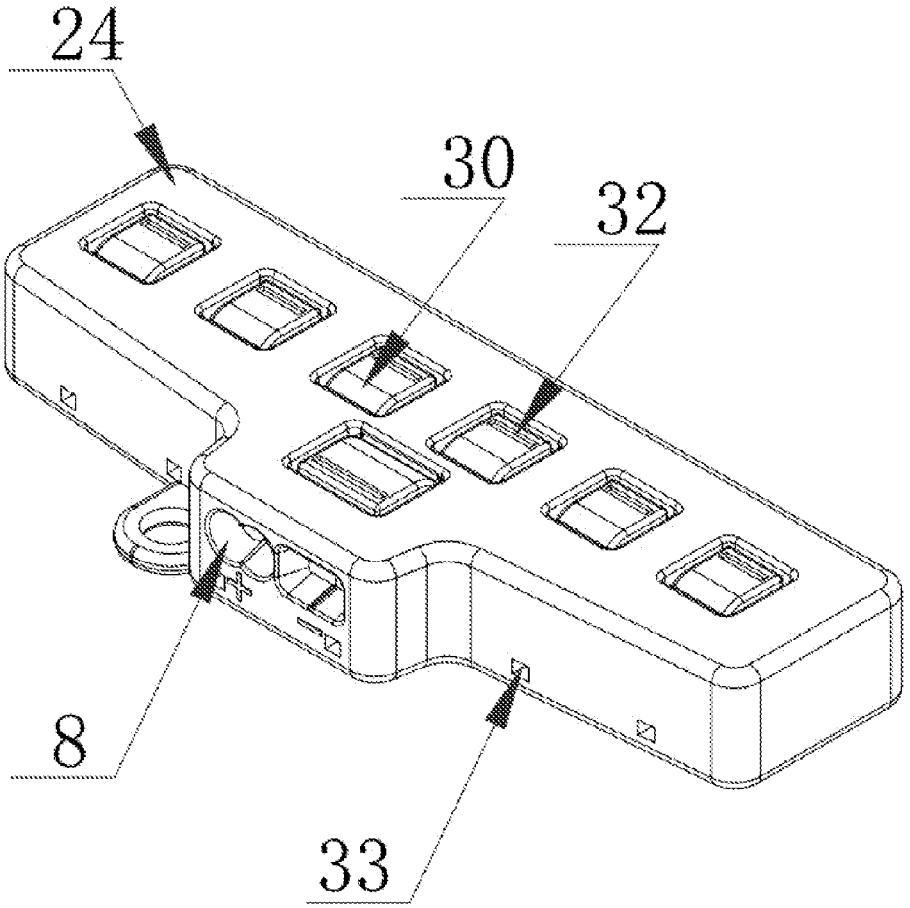
FIG. 4 is a structural view of the upper shell according to embodiment 1 of the present invention.
Figure 5:
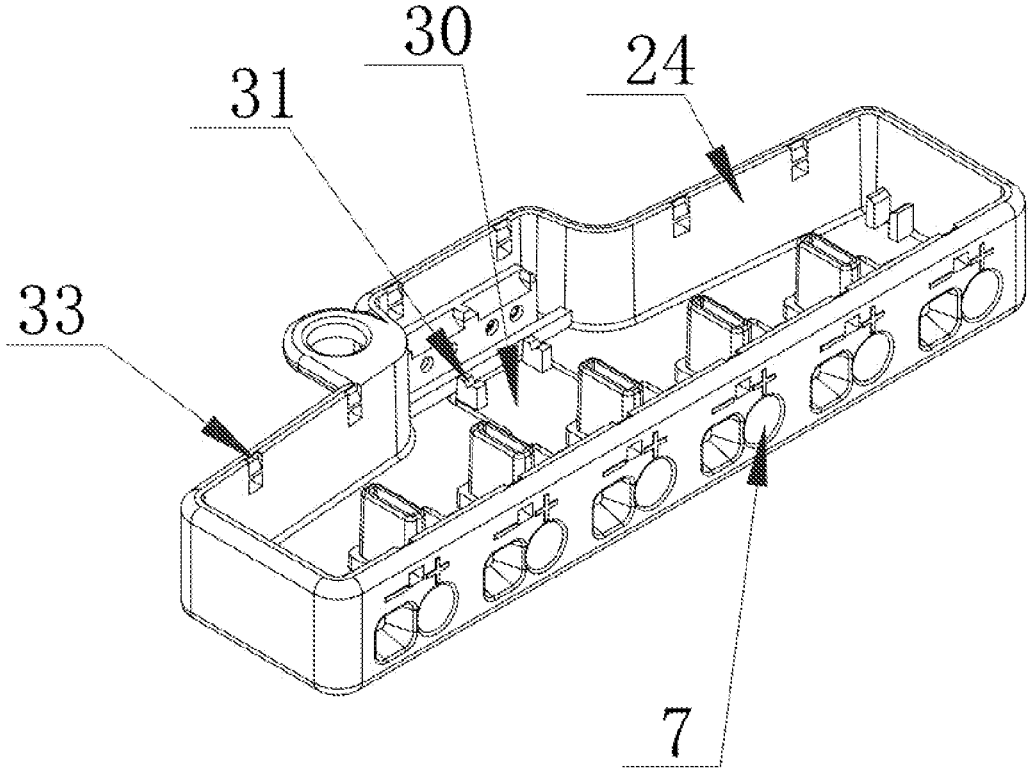
FIG. 5 is the same upper shell of FIG. 4 shown in another angle of view.
Figure 6:
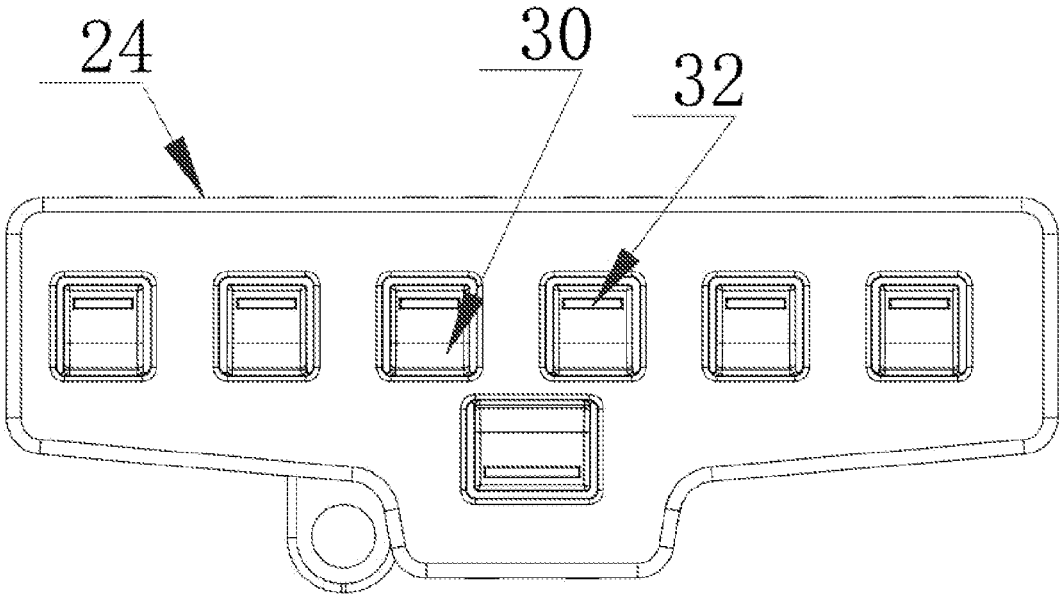
FIG. 6 is a top plan view of the upper shell according to embodiment 1 of the present invention.
Figure 7:
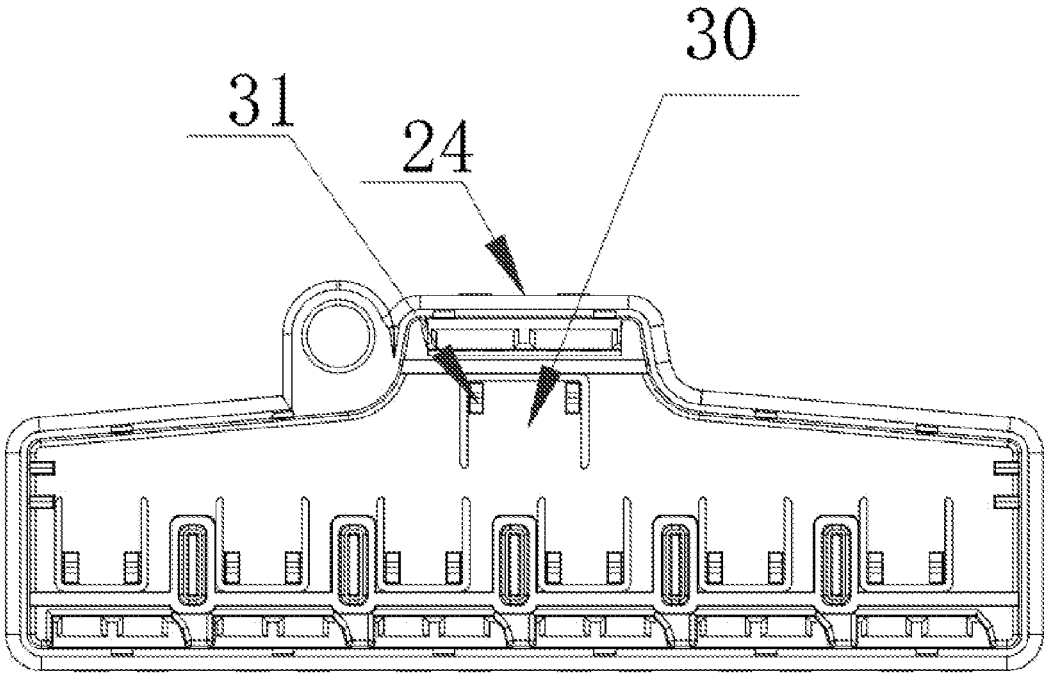
FIG. 7 is a bottom plan view of the upper shell according to embodiment 1 of the present invention.
Figure 8:
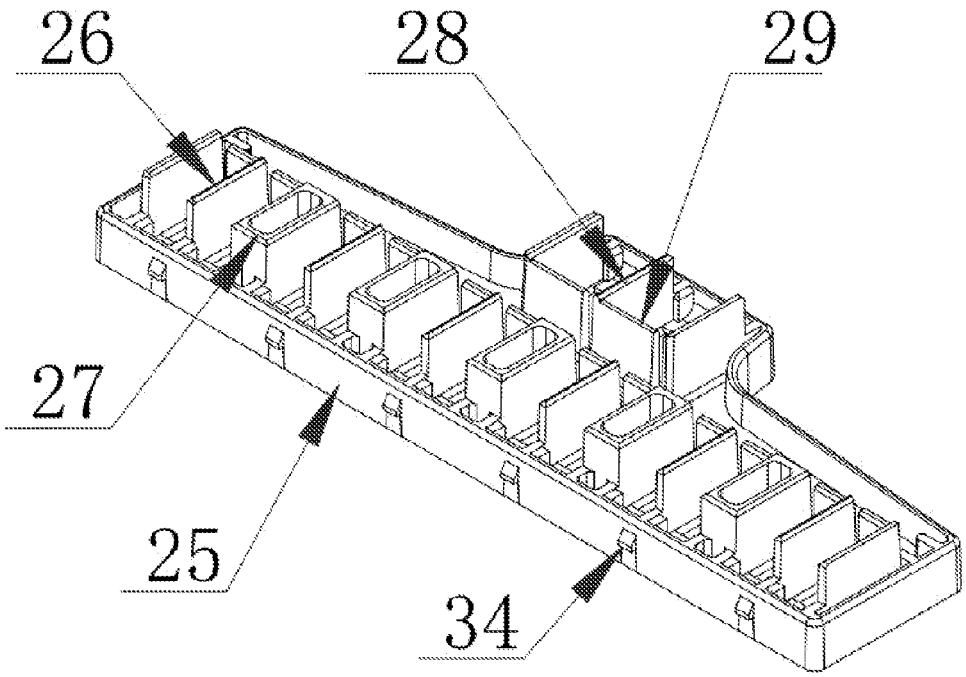
FIG. 8 is a structural view of the lower shell according to embodiment 1 of the present invention.
Figure 9:
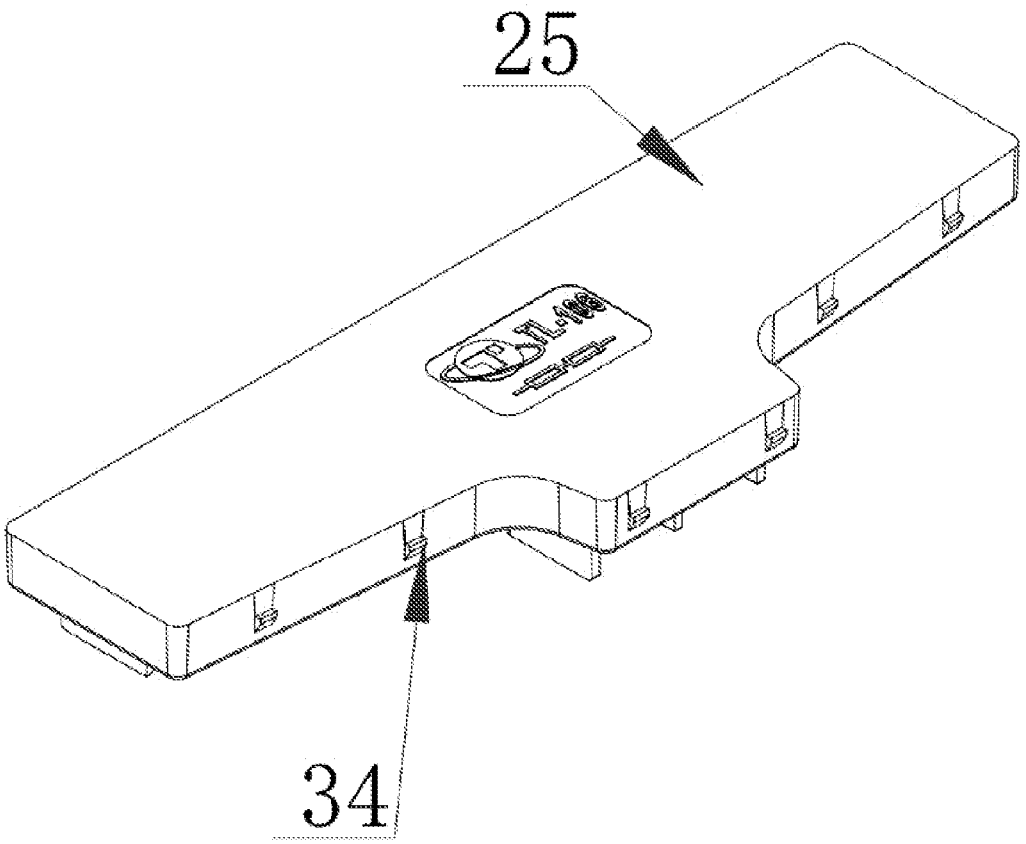
FIG. 9 is the same lower shell of FIG. 8 shown in another angle of view.
Figure 10:
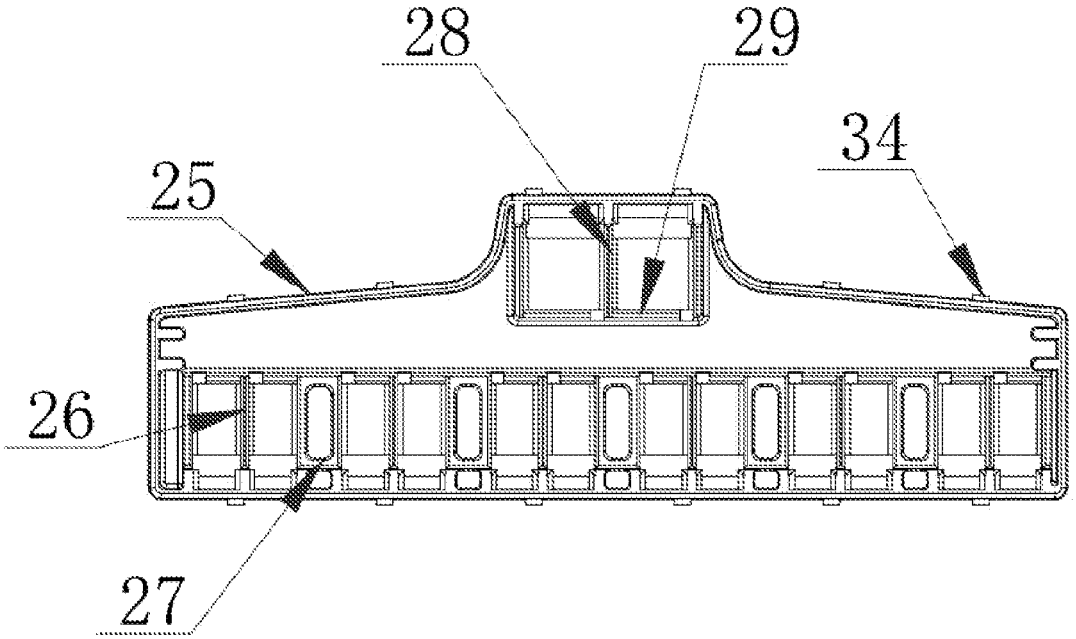
FIG. 10 is a top plan view of the lower shell according embodiment 1 of the present invention.
Figure 11:
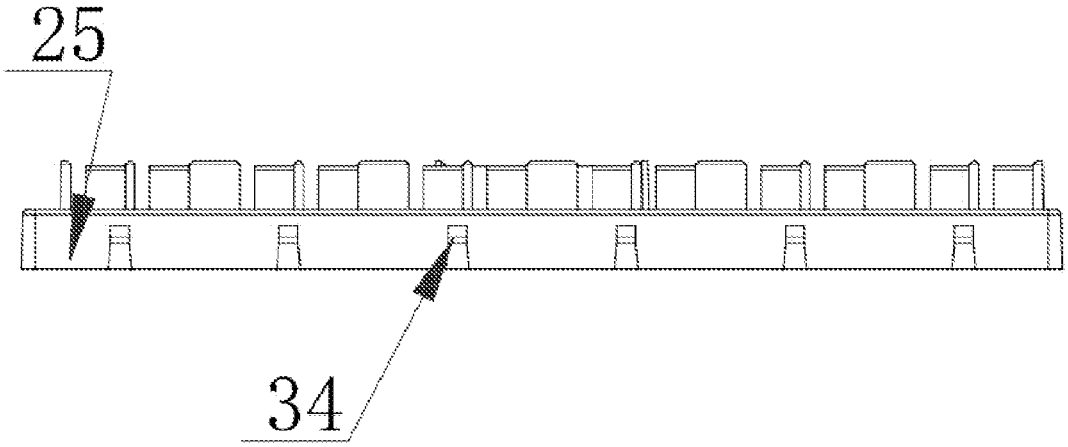
FIG. 11 is a front elevational view of the lower shell according to embodiment 1 of the present invention.
Figure 12:
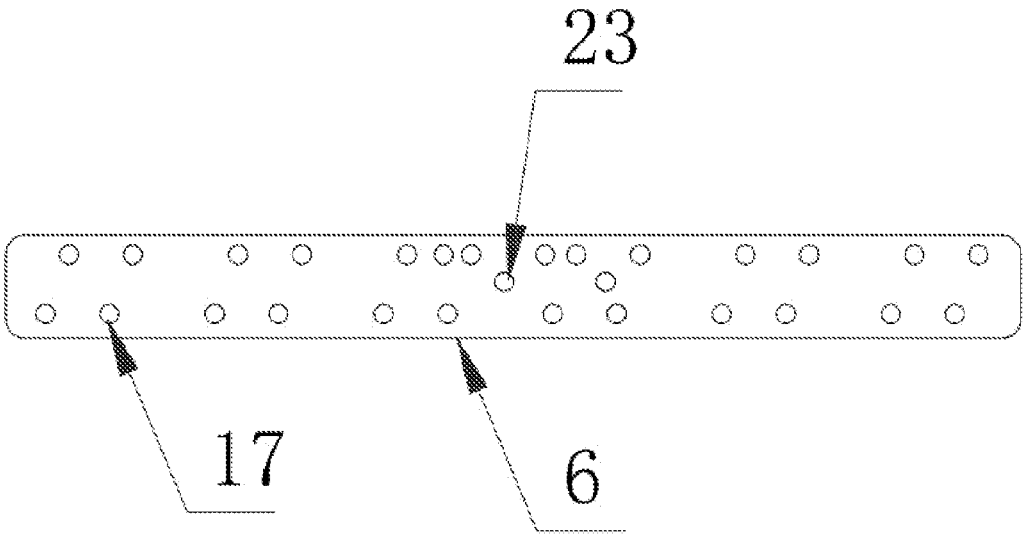
FIG. 12 is a structural view of the circuit board according to embodiment 1 of the present invention.
Figure 13:
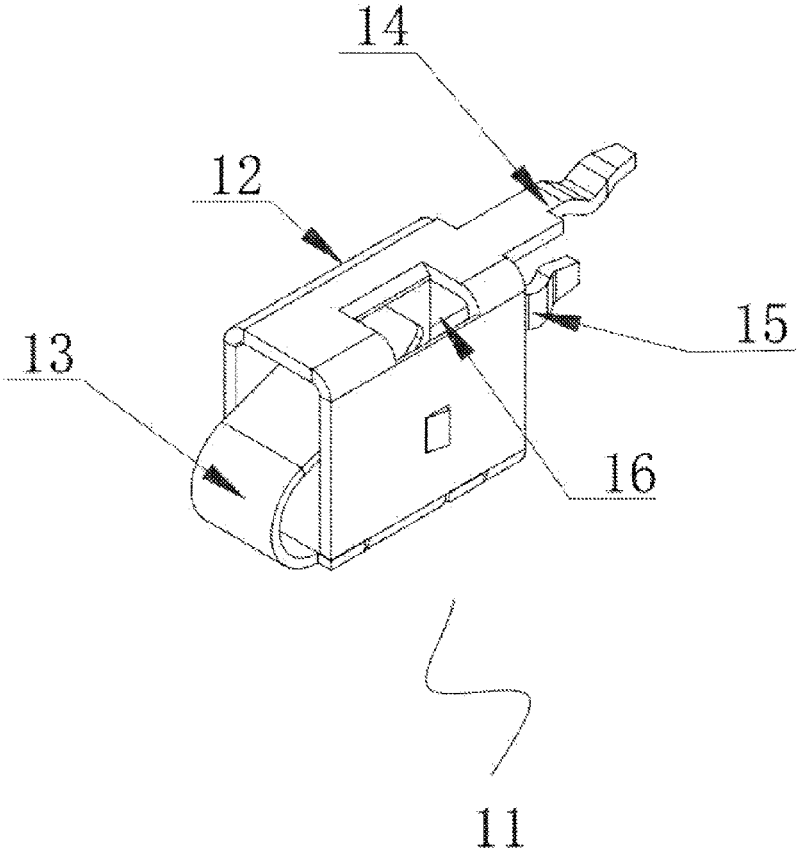
FIG. 13 is a structural view of a front wire connection metal block according to embodiment 1 of the present invention.
Figure 14:
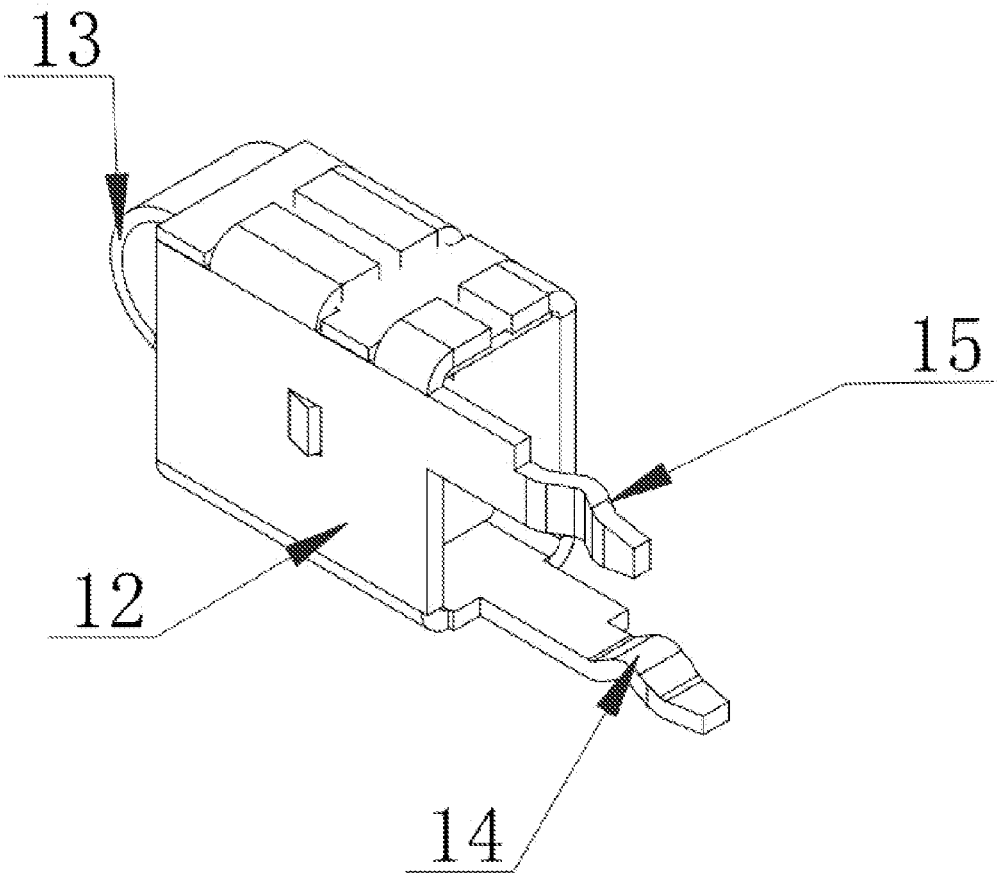
FIG. 14 is the same front wire connection metal block of FIG. 13 shown in another angle of view.
Figure 15:
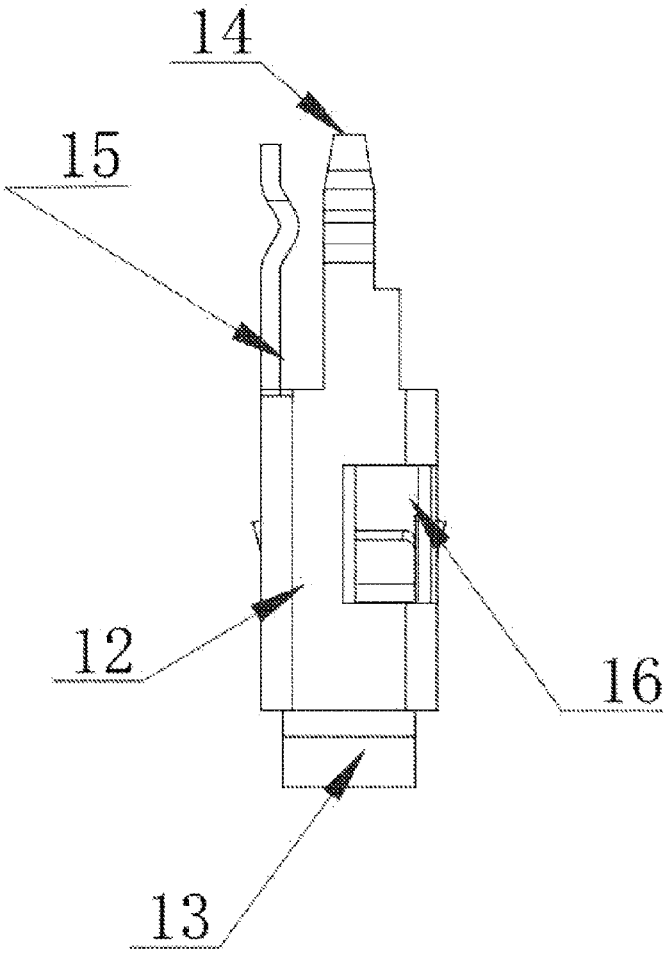
FIG. 15 is a top plan view of the front wire connection metal block according to embodiment 1 of the present invention.
Figure 16:
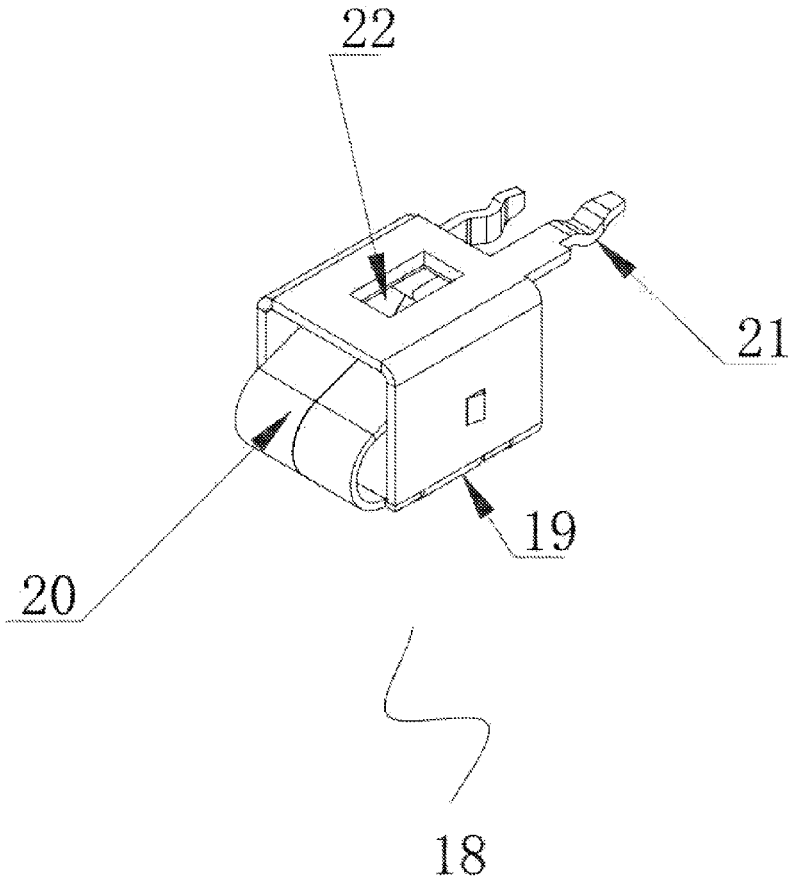
FIG. 16 is a structural view of a rear wire connection metal block according to embodiment 1 of the present invention.
Figure 17:
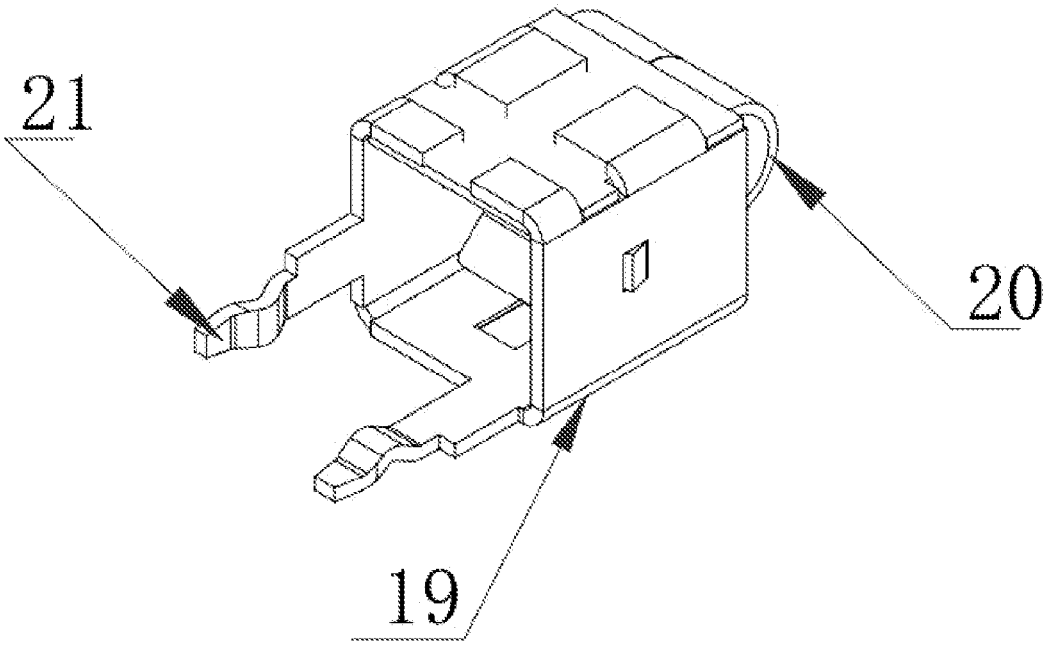
FIG. 17 is the same rear wire connection metal block of FIG. 16 shown in another angle of view.
Figure 18:
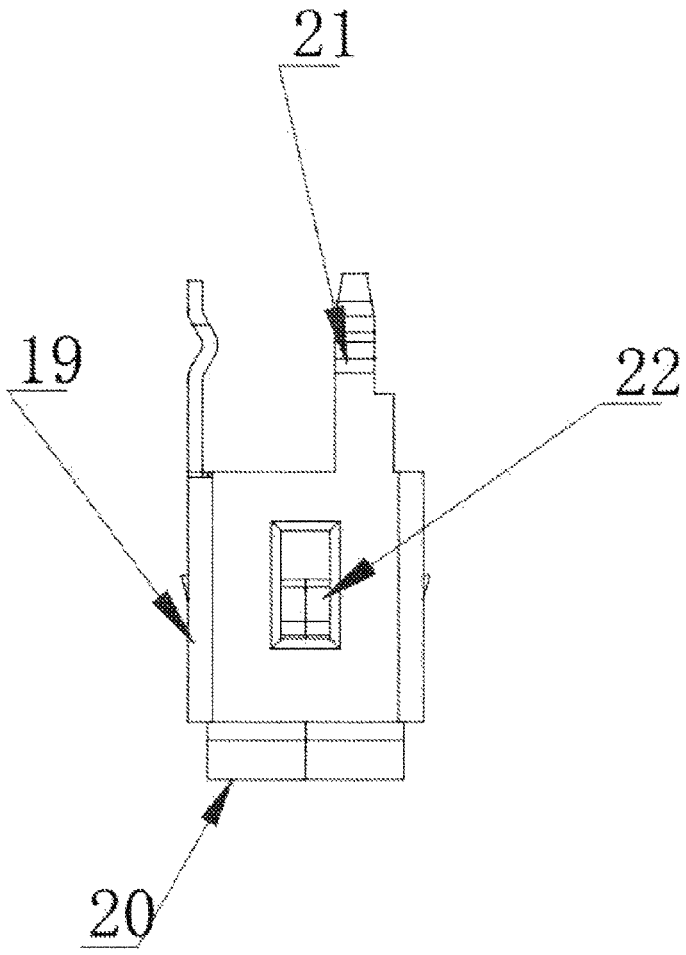
FIG. 18 is a top plan view of the rear wire connection metal block according to embodiment 1 of the present invention.
Figure 19:
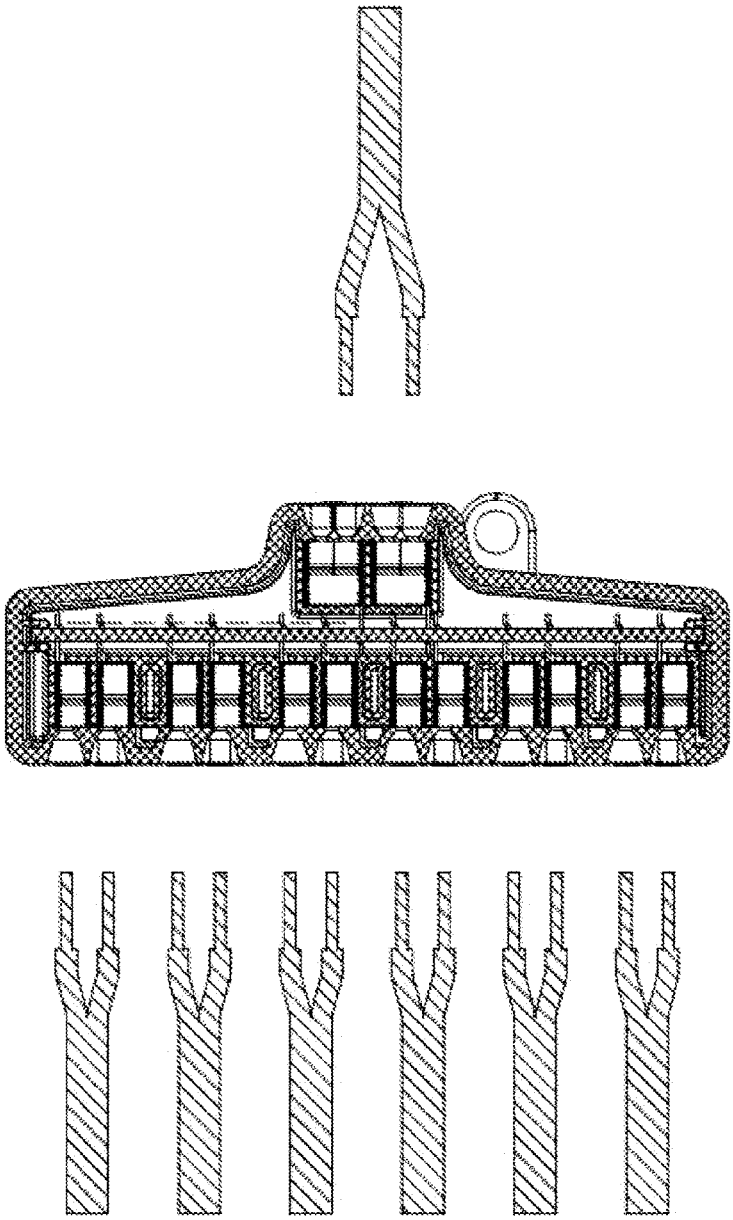
FIG. 19 is a sectional view of the splitter type terminal block connector and the wires according to embodiment 1 of the present invention, prior to their connection.
Figure 20:
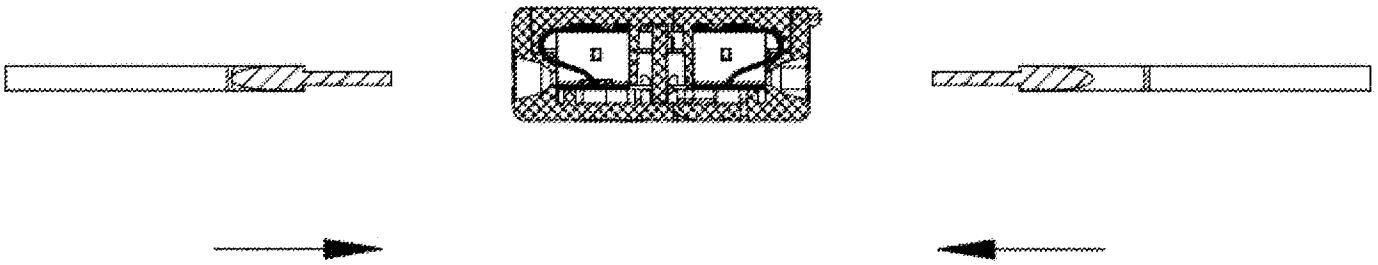
FIG. 20 is the same splitter type terminal block connector and the wires of FIG. 19 prior to their connection, shown in another sectional view sectioned in a different direction compared with FIG. 19.
Figure 21:
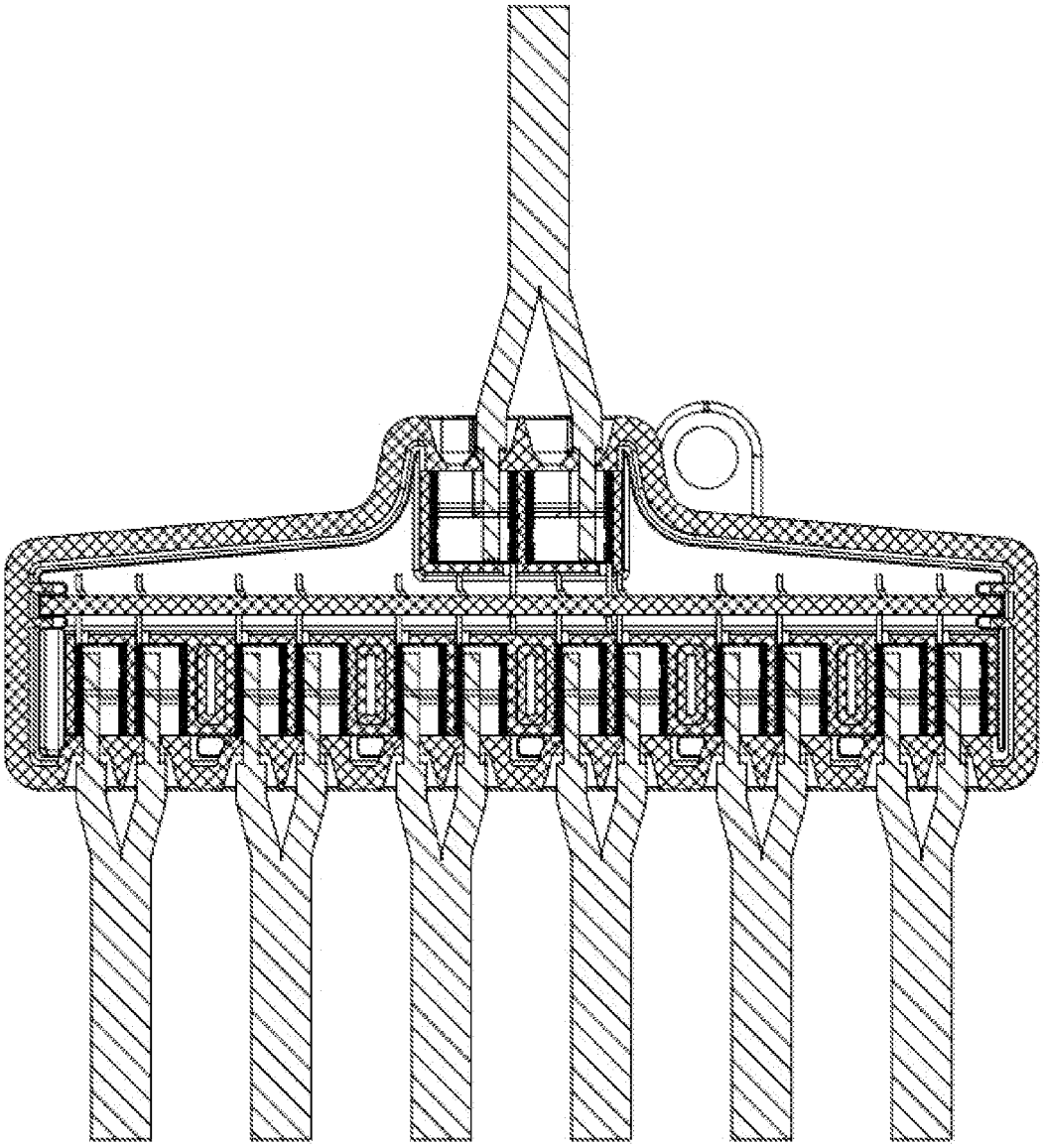
FIG. 21 is a sectional view of the splitter type terminal block connector and the wires according to embodiment 1 of the present invention when they are connected.
Figure 22:
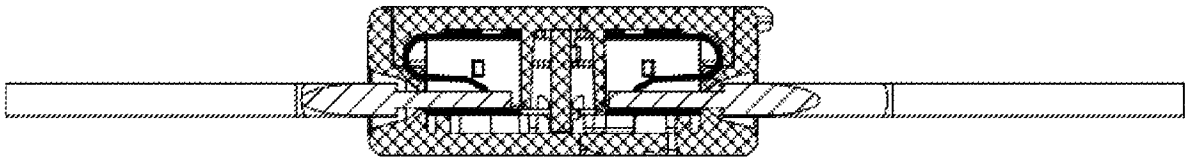
FIG. 22 is the same splitter type terminal block connector and the wires of FIG. 19 connected with one another, shown in another sectional view sectioned in a different direction compared with FIG. 21.

Embodiment 1 of the present invention as shown in FIGS. 1-22 is a splitter type terminal block connector comprising an insulated shell 1, front metal contact pieces 2 and a rear metal contact 3 mounted inside the insulated shell 1. Front fixation seats 4 for fixing the front metal contact pieces 2 and a rear fixation seat 5 for fixing the rear metal contact piece 3 are provided inside the insulated shell 1. The front metal contact pieces 2 and the rear metal contact piece 3 are electrically connected by being welded onto a circuit board 6. Front wire insertion openings 7 are provided on a front portion of the insulated shell 1 corresponding to the front fixation seats 4 and the front metal contact pieces 2. A rear wire insertion opening 8 is provided on a rear portion of the insulated shell 1 corresponding to the rear fixation seat 5 and the rear metal contact piece 3. A top portion of the insulated shell 1 is provided with front press buttons 9 through the insulated shell 1 and corresponding to the front metal contact pieces 2, and a rear press button 10 through the insulated shell 1 and corresponding to the rear metal contact piece 3. Coordination between the front press buttons 9 and the front metal contact pieces 2 and between the rear press button 10 and the rear metal contact piece 3 allows wire connection and disconnection with the front metal contact pieces 2 and the rear metal contact piece 3 respectively. There are at least two front metal contact pieces 2 and one rear metal contact piece 3. Each of the front metal contact pieces 2 has two front wire connection metal blocks 11 adjacent and connected with each other. Each of the front wire connection metal blocks 11 comprises a hollow front rectangular frame 12, a front resilient metal strip 13 having one end formed at a bottom side of one end of the front rectangular frame 12 and another end curled upward in a C shape so as to insert into the front rectangular frame 12 and abut against an inner top side of the front rectangular frame 12, a long pin 14 and a short pin 15 provided at an upper part and a lower part of another end of the front rectangular frame 12 and integrated integrally with the front rectangular frame 12 as a one whole piece, and a front hole 16 positioned on a top part of the front wire connection metal block to allow a press end of a respective front press button to pass through to press against the front resilient metal strip 13. Front insertion holes 17 corresponding to the short pin and long pin of each of the front wire connection metal blocks 11 are provided on the circuit board 6. The rear metal contact piece 3 has two rear wire connection metal blocks 18 adjacent and connected to each other. Each of the rear wire connection metal blocks 18 comprises a hollow rear rectangular frame 19, a rear resilient metal strip 20 having one end formed at a bottom side of one end of the rear rectangular frame 19 and another end curled upward in a C shape so as to insert into the rear rectangular frame 19 and abut against an inner top side of the rear rectangular frame 19, two rear pins 21 are provided at an upper part and a middle part of another end of the rear rectangular frame 19 respectively and integrated integrally with the rear rectangular frame 19 as a one whole piece, and a rear hole 22 positioned on a top part of the rear wire connection metal block 18 to allow a press end of the rear press button 10 to pass through to press against the rear resilient metal strip 20. Rear insertion holes 23 corresponding to the rear pins are provided on the circuit board 6. The two rear pins 21 of the rear rectangular frame 19 are provided at different sides of said another end of the rear rectangular frame 19.

The rear rectangular frame 19 is larger than the front rectangular frame 12; each of the rear pins 21 has a same length as the long pin 14; the front hole 16 is positioned at one side of a top part of the front rectangular frame 12; the rear hole 22 is positioned at the middle of a top part of the rear rectangular frame 19.

The insulated shell 1 is formed by an upper shell 24 and a lower shell 25. The front fixation seats 4 and the rear fixation seat 5 are configured in the lower shell 25. The front press buttons 9 and the rear press button 10 are configured on the upper shell and are integrally formed with the upper shell as a one whole piece. The front fixation seats 4 are formed by locking panels 26 and rectangular locking blocks 27 for fixing the front wire connection metal blocks 11, wherein each of the front wire connection metal blocks is sandwiched between two respective locking panels or between a respective locking panel and a respective rectangular locking block so as to be limited and fixed in position. The rear fixation seat 5 are formed by three sideward blocking panels 28 and two limiting panels 29; a side of the rear fixation seat 5 corresponding to the rear wire insertion opening 8 is not being blocked.

Each of the front press buttons 9 and the rear press button 10 is formed by a resilient press strip 30 and downwardly protruding press tips 31 formed at a bottom side of the resilient press strip 30. The press tips 31 correspondingly pass through the front hole/the rear hole to press against respective front resilient metal strips/rear resilient metal strips. An anti-slippery groove 32 enabling easier pressing is provided respectively on a top part of each of the front press buttons and the rear press button.

Locking slots 33 are provided on a side wall of the upper shell 24; buckles 34 that fittingly correspond to the locking slots 33 to enable connection and fixation between the upper shell 24 and the lower shell 25 are provided on the lower shell 25.

The circuit board 6 uses series circuit power connection or parallel circuit power connection.

The above description only describes a more preferred embodiment of the present invention and does not intend to limit the technical scheme of the present invention. Any simple changes, modifications and equivalent alternatives adopted based on the essence of the technical scheme of the present invention should also fall within the scope of protection of the present invention.

What is claimed is:

1. A splitter type terminal block connector comprising an insulated shell; front metal contact pieces and a rear metal contact mounted inside the insulated shell; front fixation seats for fixing the front metal contact pieces and a rear fixation seat for fixing the rear metal contact piece are provided inside the insulated shell; the front metal contact pieces and the rear metal contact piece are electrically connected by being welded onto a circuit board; front wire insertion openings corresponding to the front fixation seats and the front metal contact pieces are provided on a front portion of the insulated shell; a rear wire insertion opening corresponding to the rear fixation seat and the rear metal contact piece is provided on a rear portion of the insulated shell; a top portion of the insulated shell is provided with front press buttons through the insulated shell and corresponding to the front metal contact pieces, and a rear press button through the insulated shell and corresponding to the rear metal contact piece; coordination between the front press buttons and the front metal contact pieces and between the rear press button and the rear metal contact piece allows wire connection and disconnection with the front metal contact pieces and the rear metal contact piece respectively; there are at least two front metal contact pieces and one rear metal contact piece; wherein each of the front metal contact pieces has two front wire connection metal blocks adjacent and connected with each other; each of the front wire connection metal blocks comprises a hollow front rectangular frame, a front resilient metal strip having one end formed at a bottom side of one end of the front rectangular frame and another end curled upward in a C shape so as to insert into the front rectangular frame and abut against an inner top side of the front rectangular frame, a long pin and a short pin integrated integrally with the front rectangular frame as a one whole piece and provided at an upper part and a lower part of another end of the front rectangular frame respectively, and a front hole positioned on a top part of the front wire connection metal block to allow a press end of a respective front press button to pass through to press against the front resilient metal strip; front insertion holes corresponding to the short pin and the long pin of each of the front wire connection metal blocks are provided on the circuit board; the rear metal contact piece has two rear wire connection metal blocks adjacent and connected to each other; each of the rear wire connection metal blocks comprises a hollow rear rectangular frame, a rear resilient metal strip having one end formed at a bottom side of one end of the rear rectangular frame and another end curled upward in a C shape so as to insert into the rear rectangular frame and abut against an inner top side of the rear rectangular frame, two rear pins provided at an upper part and a middle part of another end of the rear rectangular frame respectively and integrated integrally with the rear rectangular frame as a one whole piece, and a rear hole positioned on a top part of the rear wire connection metal block to allow a press end of the rear press button to pass through to press against the rear resilient metal strip; rear insertion holes corresponding to the rear pins are provided on the circuit board; the two rear pins of the rear rectangular frame are provided at different sides of said another end of the rear rectangular frame.

2. The splitter type terminal block connector according to claim 1, wherein the rear rectangular frame is larger than the front rectangular frame; each of the rear pins has a same length as the long pin; the front hole is positioned at one side of a top part of the front rectangular frame; the rear hole is positioned at the middle of a top part of the rear rectangular frame.

3. The splitter type terminal block connector according to claim 2, wherein the insulated shell is formed by an upper shell and a lower shell; the front fixation seats and the rear fixation seat are configured in the lower shell; the front press buttons and the rear press button are configured on the upper shell and are integrally formed with the upper shell as a one whole piece; the front fixation seats are formed by locking panels and rectangular locking blocks for fixing the front wire connection metal blocks 11, each of the front wire connection metal blocks is sandwiched between two respective locking panels or between a respective locking panel and a respective rectangular locking block so as to be limited and fixed in position; the rear fixation seat is formed by three sideward blocking panels and two limiting panels; a side of the rear fixation seat corresponding to the rear wire insertion opening is not being blocked.

4. The splitter type terminal block connector according to claim 3, wherein each of the front press buttons and the rear press button is formed by a resilient press strip and downwardly protruding press tips formed at a bottom side of the resilient press strip; the press tips correspondingly pass through the front hole/the rear hole to press against respective front resilient metal strips/rear resilient metal strips; an anti-slippery groove enabling easier pressing is provided respectively on a top part of each of the front press buttons and the rear press button.

5. The splitter type terminal block connector according to claim 4, wherein locking slots are provided on a side wall of the upper shell; buckles that fittingly correspond to the locking slots to enable connection and fixation between the upper shell and the lower shell are provided on the lower shell.

6. The splitter type terminal block connector according to claim 5, wherein the circuit board uses series circuit power connection or parallel circuit power connection.

* * * * *